US010201201B2

(12) United States Patent
Gross et al.

(10) Patent No.: US 10,201,201 B2
(45) Date of Patent: Feb. 12, 2019

(54) LIQUID CARRYING APPARATUS

(71) Applicant: Under Armour, Inc., Baltimore, MD (US)

(72) Inventors: Shane Gross, Baltimore, MD (US); Godfrey Charles von Nordeck, III, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 143 days.

(21) Appl. No.: 15/184,591

(22) Filed: Jun. 16, 2016

(65) Prior Publication Data

US 2017/0360130 A1 Dec. 21, 2017

(51) Int. Cl.

| | |
|---|---|
| ***A41D 19/00*** | (2006.01) |
| ***A41D 27/20*** | (2006.01) |
| ***A41D 27/10*** | (2006.01) |
| ***A41F 9/00*** | (2006.01) |
| ***A45F 3/20*** | (2006.01) |
| *A45F 5/02* | (2006.01) |
| *A45F 3/16* | (2006.01) |

(52) U.S. Cl.

CPC ..... *A41D 27/20* (2013.01); *A41D 19/002* (2013.01); *A41D 27/10* (2013.01); *A41F 9/002* (2013.01); *A45F 3/20* (2013.01); *A41D 2400/46* (2013.01); *A45F 5/022* (2013.01); *A45F 2003/166* (2013.01); *A45F 2200/0583* (2013.01)

(58) Field of Classification Search

CPC ..... A41D 19/002; A41D 13/001; A41D 27/20
See application file for complete search history.

(56) References Cited

U.S. PATENT DOCUMENTS

| | | | | |
|---|---|---|---|---|
| 4,988,097 | A | 1/1991 | Smith et al. | |
| D323,430 | S | 1/1992 | Niederkorn | |
| D373,240 | S | 9/1996 | Parnell | |
| 5,566,869 | A | 10/1996 | Katz | |
| D408,988 | S | 5/1999 | Barber et al. | |
| 5,957,347 | A | 9/1999 | White et al. | |
| 6,126,041 | A | 10/2000 | DiTomasso et al. | |
| 6,173,866 | B1 | 1/2001 | Taylor, Jr. et al. | |
| 6,409,048 | B1 | 6/2002 | Belzeski | |
| 6,454,132 | B2 | 9/2002 | Campion | |
| 6,626,733 | B1 * | 9/2003 | Knutson | A41C 3/0057 2/247 |

(Continued)

*Primary Examiner* — Tejash Patel
(74) *Attorney, Agent, or Firm* — Maginot, Moore & Beck LLP

(57) ABSTRACT

An apparatus for carrying liquid includes a liquid container and an article of apparel. The liquid container includes a body, which is configured to removably receive the liquid, and a cap, which is configured to selectively seal the body. The article of apparel includes a pocket, which has an interior configured to removably receive the body. The article of apparel also includes a first opening and a second opening, each of which is in communication with the pocket interior. The first opening passes the liquid container, and the second opening passes the cap. The article of apparel further includes a flap, which is movably coupled to the article of apparel. The flap includes a third opening, which passes the cap. The flap is coupled to the article of apparel and movable between a first position, covering the first opening, and a second position, not covering the first opening.

20 Claims, 10 Drawing Sheets

(56) References Cited

U.S. PATENT DOCUMENTS

| | | | | |
|---|---|---|---|---|
| 7,135,011 | B2 | 11/2006 | Powers et al. | |
| 8,167,177 | B1 | 5/2012 | Galgano | |
| 8,387,831 | B2 | 3/2013 | McInerney | |
| 8,622,262 | B2 | 1/2014 | Van Art | |
| 9,775,428 | B2 * | 10/2017 | Johnson | A45F 5/00 |
| 2004/0028296 | A1 * | 2/2004 | Meli | B65D 81/3888 383/110 |
| 2004/0211699 | A1 * | 10/2004 | Kucharski | A45F 3/20 206/545 |
| 2012/0048898 | A1 | 3/2012 | Franklin et al. | |
| 2012/0152986 | A1 | 6/2012 | Van Art | |
| 2014/0117058 | A1 | 5/2014 | Burtman | |
| 2016/0135573 | A1 * | 5/2016 | Smith | A45F 3/20 222/175 |
| 2017/0221693 | A1 * | 8/2017 | Kim | H01J 49/10 |

* cited by examiner

LIQUID CARRYING APPARATUS

BACKGROUND

The importance of being hydrated and staying hydrated, especially during physical activities, is well known. This is particularly important for athletes who are able to achieve better performance while maintaining appropriate levels of hydration. However, staying hydrated during physical activity requires repeated access to liquid, which can be difficult and inconvenient. The availability of liquid is one issue facing those performing physical activities. For example, during performance of a long-distance run, an athlete may not always be near a source of usable liquid. Additionally, during performance of a long-duration physical activity, an athlete may not wish to repeatedly pause in the performance of the activity to return to a source of usable liquid.

Many athletes prefer to consume liquids during physical activities which are enhanced or enriched with a variety of nutrients to further facilitate better performance. Some athletes also prefer to prepare their own liquids including particular amounts of nutrients which are selected based on the athlete's personal needs and preferences. Accordingly, even if the athlete has access to a source of liquid during the performance of physical activities, it may not provide the athlete's preferred liquid.

One way in which athletes have attempted to address these issues is by carrying their own liquids. This method is more useful during an activity such as a long-distance run or bike ride, where the user can keep the liquid close at hand and access it as desired. However, one drawback of this method is that liquid is relatively heavy and amorphous. Accordingly, it can be difficult for an athlete to comfortably carry the liquid for a long period of time. Some athletes may experience rubbing or chafing from carrying liquid in inadequate containers for a long period of time. Additionally, some athletes experience discomfort from the imbalance of weight created by carrying the liquid. It would be desirable to provide a liquid carrying apparatus which is comfortable to be carried by a user for a long period of time.

Even for athletes comfortable with carrying their own liquid, it is not always practical for athletes participating in certain athletic activities. For example, during a soccer, football, or basketball practice, it is a priority for the athlete to be able to use both hands and not be distracted by holding on to extraneous objects. In these cases, athletes must forgo liquid or pause in the performance of their activity to access liquid. It would be desirable to provide a liquid carrying apparatus which a user or athlete can carry and use without losing use of both hands and without being distracted by having to hold on to extraneous objects.

SUMMARY

An apparatus for carrying liquid includes a liquid container and an article of apparel. The liquid container includes a body configured to removably receive the liquid and a cap configured to selectively seal the body. The article of apparel includes a pocket having an interior configured to removably receive the body. The article of apparel further includes a first opening in communication with the interior of the pocket. The first opening is configured to pass the liquid container. The article of apparel further includes a second opening in communication with the interior of the pocket. The second opening is configured to pass the cap. The article of apparel further includes a flap fixedly coupled to the article of apparel. The flap includes a third opening configured to pass the cap.

In at least one embodiment, the flap is positionable relative to the article of apparel such that the third opening is coaxial with the second opening such that the cap is passable through both the second opening and the third opening at once. This position of the flap relative to the article of apparel helps to retain the liquid container in a desired position during use.

In at least one embodiment, the article of apparel further includes a panel fixedly coupled to the article of apparel such that the pocket is formed between the panel and the article of apparel. The panel is coupled to the article of apparel around less than an entire perimeter of the panel such that a pocket opening is formed between the panel and the article of apparel. The pocket opening provides access to the interior of the pocket. The arrangement of the panel to form the pocket helps to retain the liquid container such that the weight and volume of the liquid is more comfortably distributed in the article of apparel.

In at least one embodiment, an apparatus for carrying a liquid includes an article of apparel and a liquid container. The article of apparel includes a pocket and a pocket opening, the pocket opening defined by a first side and a second side opposite the first side, a first hole positioned adjacent to the first side of the pocket opening, a flap positioned adjacent to the second side of the pocket opening, and a second hole positioned on the flap. The liquid container is retained in the pocket. The liquid container includes a liquid opening with a boss surrounding the liquid opening, the boss extending through the first hole and the second hole of the article of apparel.

DETAILED DESCRIPTION

Figure 1:
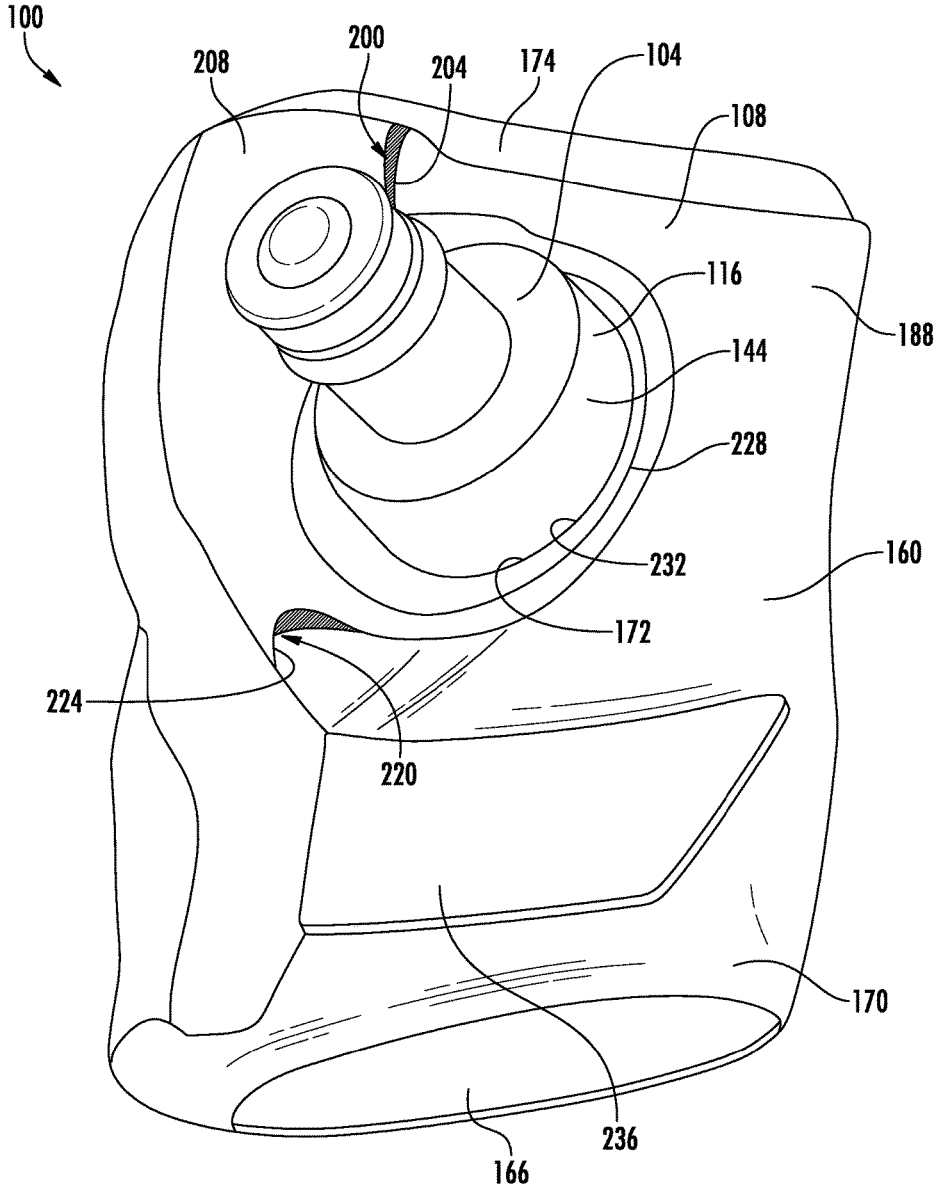
FIG. 1 depicts a front perspective view of a liquid carrying apparatus including a liquid container received within an article of apparel with a flap of the article of apparel in a closed position.
Figure 2:
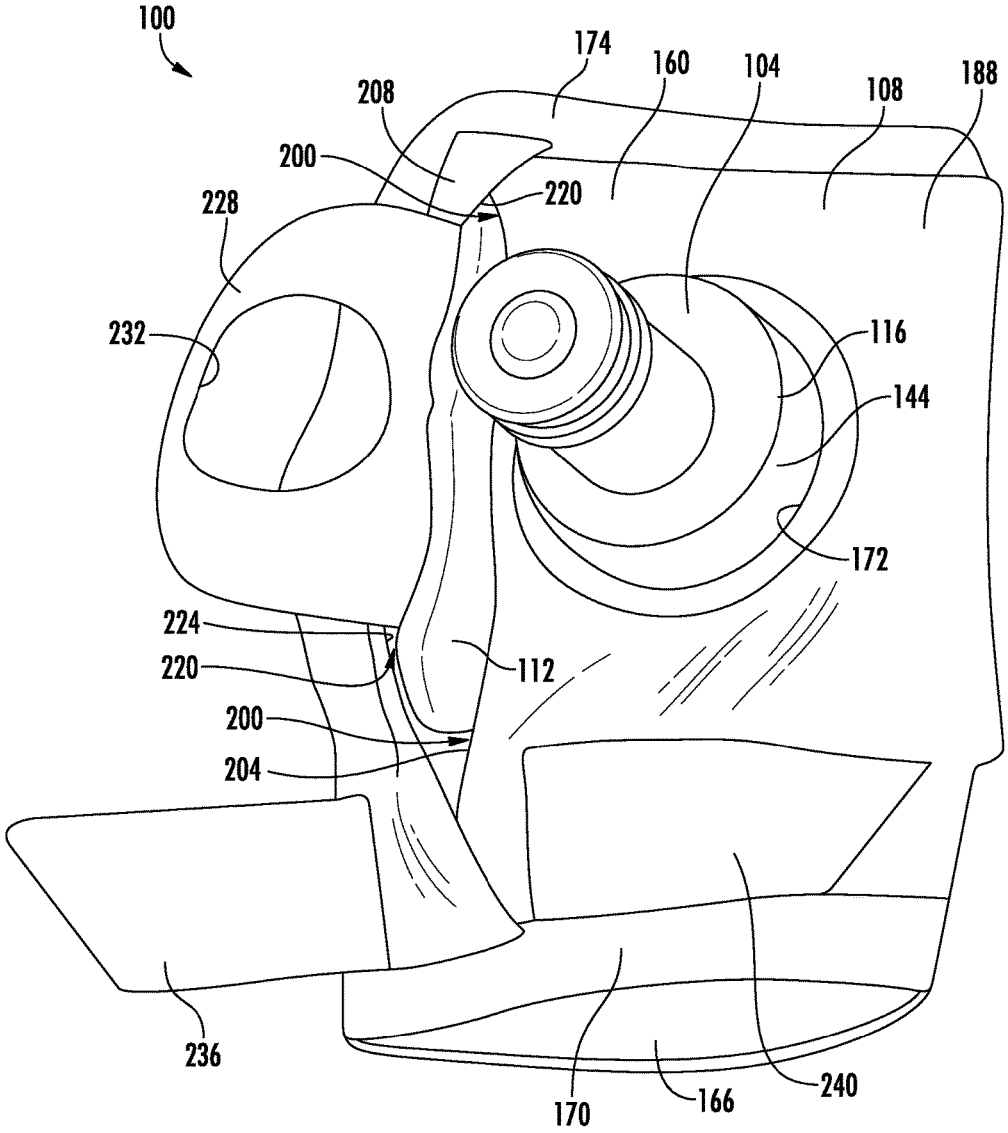
FIG. 2 depicts a front perspective view of the liquid carrying apparatus of FIG. 1 including the liquid container received within the article of apparel and the flap of the article of apparel in an opened position.

As shown in FIGS. 1 and 2, a liquid carrying apparatus 100 includes a liquid container 104 removably received within an article of apparel 108. The liquid container 104 includes a body 112 (visible in FIG. 2), which removably receives and contains liquid, and a cap 116, which is removably connectable to the body 112 to selectively seal the liquid within the body 112. The article of apparel 108 includes a pocket 200 having an interior, which removably receives the body 112 of the liquid container 104. The article of apparel 108 further includes a plurality of openings into the pocket, each of the plurality of openings configured to receive and pass portions of the liquid container 104 therethrough. The article of apparel 108 further includes a flap 208, which includes a tab opening 232 configured to pass the cap 116 of the liquid container 104 therethrough.

Liquid Container

Figure 3A:
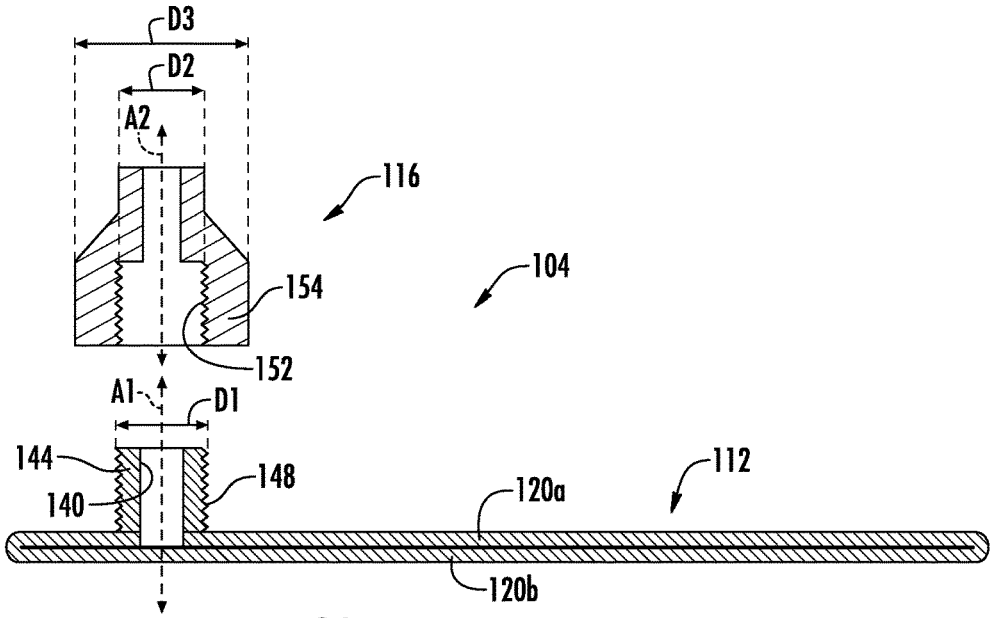
FIG. 3A depicts a side cross-sectional view of the liquid container of the liquid carrying apparatus of FIG. 1 in a flat configuration.
Figure 3B:
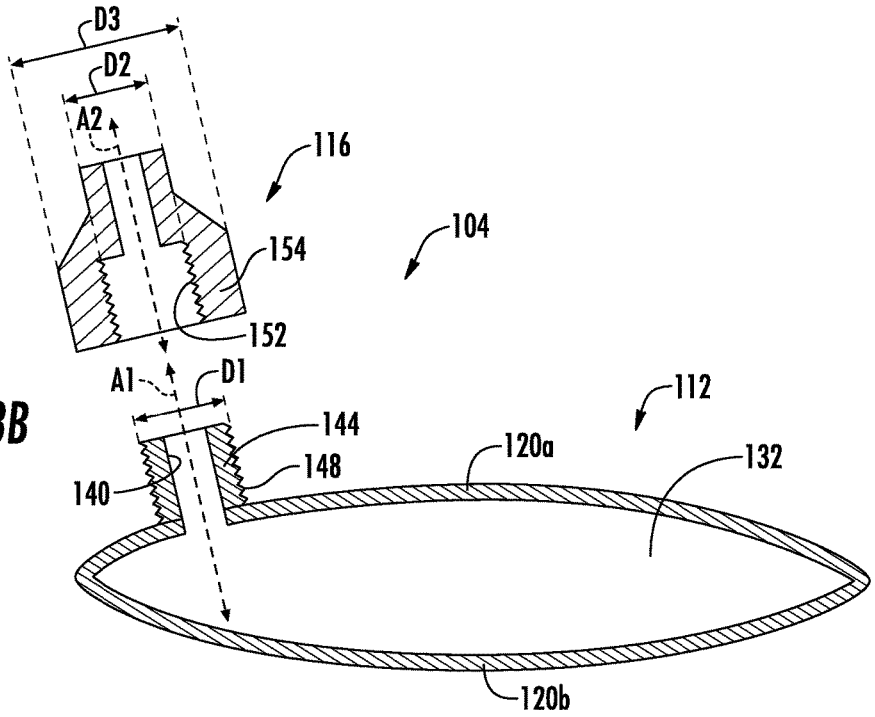
FIG. 3B depicts a side cross-sectional view of the liquid container of the liquid carrying apparatus of FIG. 1 in an expanded configuration.

As shown in FIGS. 3A and 3B, the liquid container 104, including the body 112 and the cap 116, may be provided by any container that can be removably received within the article of apparel 108 (shown in FIGS. 1 and 2) in the manner described below. In a preferred embodiment, the body 112 of the liquid container 104 is substantially comprised of a flexible material to facilitate inserting the liquid container 104 into, and removing the liquid container 104 from, the article of apparel 108. For example, the body 112 can be made of flexible polyethylene. When the liquid container 104 is substantially empty, the liquid container 104 is in a flat configuration (shown in FIG. 3A). In contrast, when the liquid container 104 is at least partially filled with liquid, the liquid container 104 is in an expanded configuration (shown in FIG. 3B.)

Figure 4:
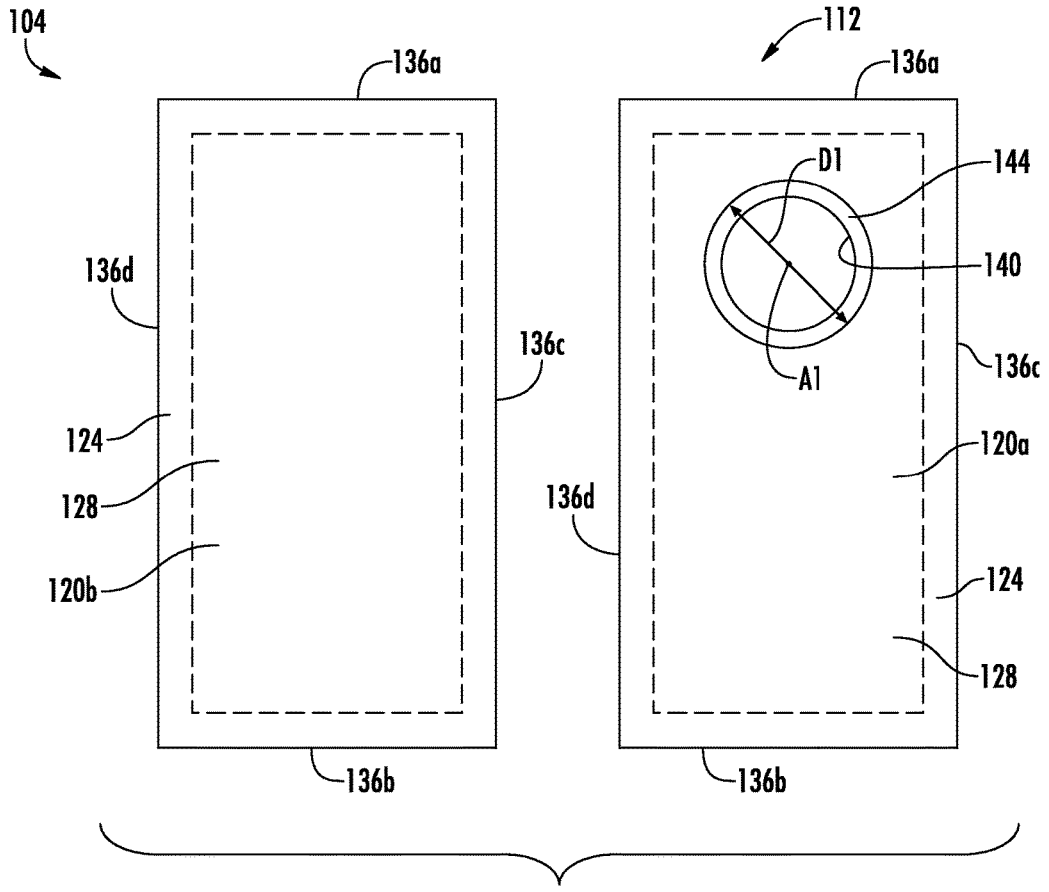
FIG. 4 depicts an exploded top plan view of the liquid container of the liquid carrying apparatus of FIG. 1.

As shown in FIG. 4, the body 112 of the liquid container 104 is made up of a first panel, also referred to herein as a top panel 120*a*, and a second panel, also referred to herein as a bottom panel 120*b*, shown separated from each other in FIG. 4. The body 112 further includes a liquid opening 140, through which liquid is inserted into and removed from the body 112 of the liquid container 104, surrounded by a boss 144.

Each of the top panel 120*a* and the bottom panel 120*b* has a perimeter 124 (indicated with a dashed line) surrounding an interior area 128. To form the body 112, the top and bottom panels 120*a*, 120*b* are coupled together along their entire perimeters 124 in a manner which seals the body 112 against the passage of liquid. For example, the top panel 120*a* and the bottom panel 120*b* can be heat-bonded together along their respective perimeters 124. However, the top panel 120*a* and the bottom panel 120*b* are not coupled to one another in their interior areas 128. Accordingly, the space between the interior areas 128 of the top and bottom panels 1240*a*, 120*b* forms an interior volume 132 of the body 112 (shown in FIG. 3B) which can retain the liquid within the body 112 and enables the liquid container 104 to be configured in the expanded configuration. Because the body 112 is substantially comprised of a flexible material, when the interior volume 132 is filled with liquid and the liquid container 104 is in the expanded configuration, the interior areas 128 of the top and bottom panels 120*a*, 120*b* are spaced apart from one another and the shape of the body 112 is changed, like a bladder.

The dimensions of the body 112 determine the interior volume 132, and the dimensions of the body 112 are, at least in part, determined by the shape and size of the article of apparel 108 (shown in FIGS. 1 and 2). The interior volume 132 is small enough to enable the liquid container 104 to be received within the article of apparel 108, even when filled with liquid. Furthermore, the interior volume 132 is small enough to enable the user to carry the apparatus 100 easily and comfortably. The interior volume 132 is also large enough to provide a useful quantity of liquid to the user. In the embodiment shown, the interior volume 132 of the body 112 is 150 mL. Accordingly, the body 112 can contain up to 150 mL of liquid. In alternative embodiments, the interior volume 132 can be larger or smaller than 150 mL. For example, the interior volume 132 can be between 50 mL and 1 L. More preferably, the interior volume 132 can be between 150 mL and 300 mL.

In the embodiment shown in FIG. 4, each of the top panel 120*a* and the bottom panel 120*b* is a substantially rectangular-shaped panel having two short edges 136*a*, 136*b* and two long edges 136*c*, 136*d*. The shapes of the top and bottom panels 120*a*, 120*b* are the same such that the top panel 120*a* and the bottom panel 120*b* can be sealed along their perimeters 124. Because the top panel 120*a* is directly coupled to the bottom panel 120*b*, the liquid container 104 still maintains a relatively flat profile when it is in the expanded configuration (shown in FIG. 3B). Thus, the liquid container 104 is able to be more easily inserted into and removed from the article of apparel 108 (shown in FIGS. 1 and 2) and is able to be more easily carried in the article of apparel 108 because the volume and the weight of the liquid are distributed over a relatively large surface area to reduce bulging and sagging of the article of apparel 108. In other words, the shape of the body 112 helps provide comfort to the user carrying the liquid carrying apparatus 100.

In alternative embodiments, the top panel 120*a* and the bottom panel 120*b* can have other shapes with corresponding numbers of edges, and the edges of the panels can be sized to produce regular polygons, irregular polygons, symmetrical shapes, and asymmetrical shapes. For example, the top panel 120*a* and the bottom panel 120*b* can be substantially circularly shaped. Additionally, in alternative embodiments, the liquid container 104 can be made of more than a top panel 120*a* and a bottom panel 120*b*. For example, the liquid container 104 can be made in the shape of a rectangular prism having six sides. However, increasing the number of sides of the liquid container 104 may complicate manufacturing and/or assembly of the liquid container 104. Additionally, in alternative embodiments, the liquid container 104 can be made of one piece that is folded over itself to form both the top panel 120*a* and the bottom panel 120*b*. In this case, the top panel 120*a* and the bottom panel 120*b* are coupled together along the three edges other than the fold.

As shown in FIGS. 3A, 3B, and 4, the top panel 120*a* of the liquid container 104 includes the liquid opening 140, via which liquid is inserted into and removed from the interior volume 132 (shown in FIG. 3B) of the body 112, and the boss 144. In an alternative embodiment, the bottom panel 120*b* can include the liquid opening 140 and the boss 144. In the embodiment shown, the liquid opening 140 is arranged nearer to one of the short edges 136*a* of the top panel 120*a* to facilitate accessibility of the liquid opening 140 when the body 112 is received within the article of apparel 108 (shown in FIGS. 1 and 2). In alternative embodiments, however, the liquid opening 140 may be arranged in a different location on the top panel 120*a* based on the arrangement of the body 112 within the article of apparel 108.

In the embodiment shown, the boss 144 surrounding the liquid opening 140 is shaped substantially as a cylinder having an exterior diameter D1 and a central longitudinal axis A1. The boss 144 is configured to mate with the cap 116 (shown in FIGS. 3A and 3B) to removably couple the cap 116 to the liquid container 104. The boss 144 is hollow through its center such that liquid can pass through the boss 144 into and out of the liquid container 104. As shown in FIGS. 3A and 3B, the boss 144 includes external threads 148 and the cap 116 includes internal threads 152 configured to mate with the external threads 148 such that the cap 116 can be screwed onto the boss 144. In alternative embodiments, however, the boss 144 and the cap 116 can include other mating elements which enable the boss 144 to removably couple the cap 116 to the liquid container 104. Additionally, in alternative embodiments, the liquid container 104 can include an element other than a boss 144 which enables the cap 116 to be removably coupled to the liquid container 104.

Like the boss 144, the cap 116 is also hollow through its center to enable liquid to pass out of the liquid container 104. In the embodiment shown, the cap 116 includes a substantially cylindrical mating portion 154 configured to fit matingly with the boss 144, and including the internal threads 152. The mating portion 154 of the cap 116 has an interior diameter D2, an exterior diameter D3, and a central longitudinal axis A2. The interior diameter D2 of the mating portion 154 is slightly larger than the exterior diameter D1 of the boss 144 such that the mating portion 154 of the cap 116 fits over the boss 144 when the cap 116 is coupled to the body 112 of the liquid container 104. When the cap 116 is coupled to the body 112 of the liquid container 104, the central longitudinal axis A2 of the mating portion 154 of the cap 116 is approximately coaxial with the central longitudinal axis A1 of the boss 144.

The cap 116 is configured to be openable and closable using one hand or no hands to facilitate removal of liquid from the liquid container 104 while performing another activity, for example, running or cycling. Accordingly, the cap 116 can include a push and pull type nozzle which is closed by pushing the nozzle toward the liquid container 104 and opened by pulling the nozzle away from the liquid container 104. In alternative embodiments, the cap 116 can include a different type of nozzle which enables the cap 116 to be opened and closed using one hand or no hands. The cap 116 is thus fixedly coupled to the body 112 and provides hands-free or one-handed access to the liquid within the liquid container 104 such that the user does not have to pause in performing another action to access the liquid.

Article of Apparel

Returning to FIGS. 1 and 2, the article of apparel 108 is able to selectively accommodate the liquid container 104 and to be comfortably worn or carried on the user's body. Thus, the article of apparel 108 is configured to stretch to accommodate the liquid container 104 and to be worn or carried and, configured to resume its original shape when the liquid container 104 is empty or removed, and the article of apparel 108 is not being worn.

Figure 5B:
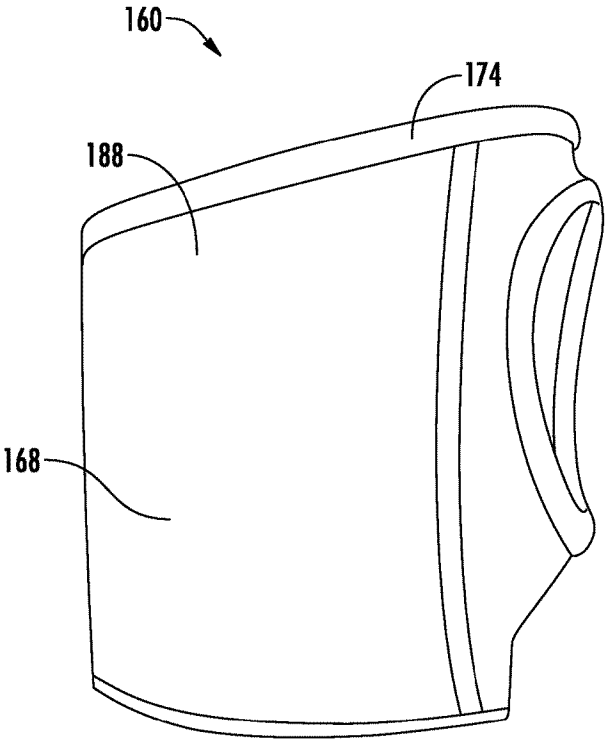
FIG. 5B depicts a back plan view of the article of apparel of the liquid carrying apparatus of FIG. 1.
Figure 5A:
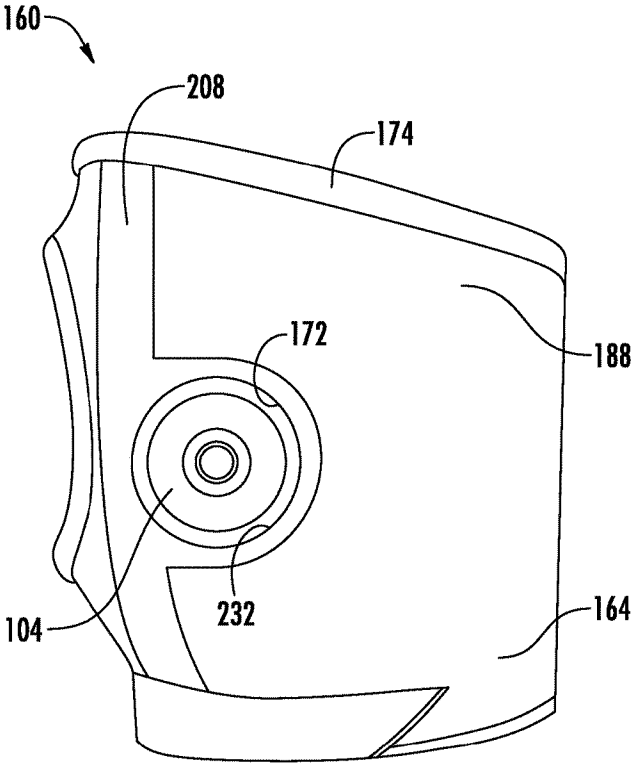
FIG. 5A depicts a front plan view of the article of apparel of the liquid carrying apparatus of FIG. 1.

The article of apparel 108 can be any garment or accessory that is worn or carried by a person and on which it is desirable to support a container of liquid. For example, the article of apparel 108 can be a belt, a backpack, a shirt, a glove, a sleeve, etc. As shown in FIGS. 5A and 5B, in the embodiment described herein, the article of apparel 108 is formed as a sleeve 160 configured as a partial glove to be worn on a user's hand so as to cover the user's hand from the user's wrist to the base of the user's fingers. In other words, the sleeve 160 is configured to cover the areas of the user's hand which contain the carpal and metacarpal bones. In alternative embodiments, the article of apparel 108 can be formed as a sleeve to be worn on another part of the user's body, such as the user's arm, or the article of apparel 108 can be formed as another shape that is not a sleeve. In the embodiment shown, the sleeve 160 is configured to be worn on the user's right hand. In alternative embodiments, the sleeve 160 can be formed inversely to be worn on the user's left hand.

When the sleeve 160 is worn by the user, the article of apparel 108 defines a first portion 164 (shown in FIG. 5A) and a second portion 168 (shown in FIG. 5B) which are arranged substantially opposite one another, but connected to one another due to the substantially cylindrical shape of the sleeve 160. In use, the first portion 164 of the sleeve 160 is arranged on the dorsal side of the user's hand and the second side 168 of the sleeve 160 is arranged on the palmar side of the user's hand. The first portion 164 of the sleeve 160 includes the cap opening 172. Accordingly, in use, the cap 116 of the liquid container 104 is accessible on the dorsal side of the user's hand leaving the palmar side of the user's hand free to grip or perform other functions.

Figure 6A:
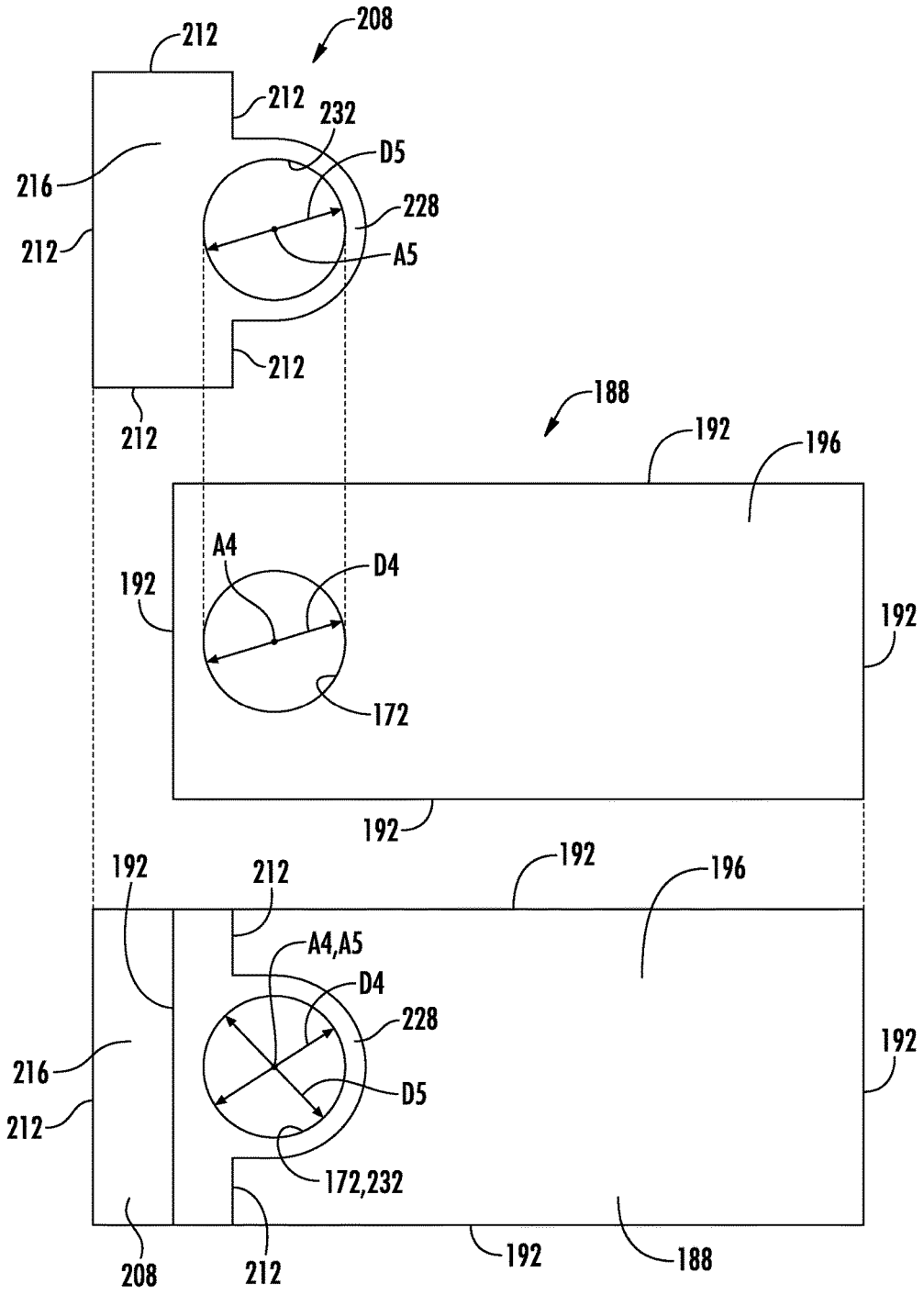
FIG. 6A depicts a schematic exploded view of a pocket portion of the article of apparel of the liquid carrying apparatus of FIG. 1 in a flat configuration.
Figure 6B:
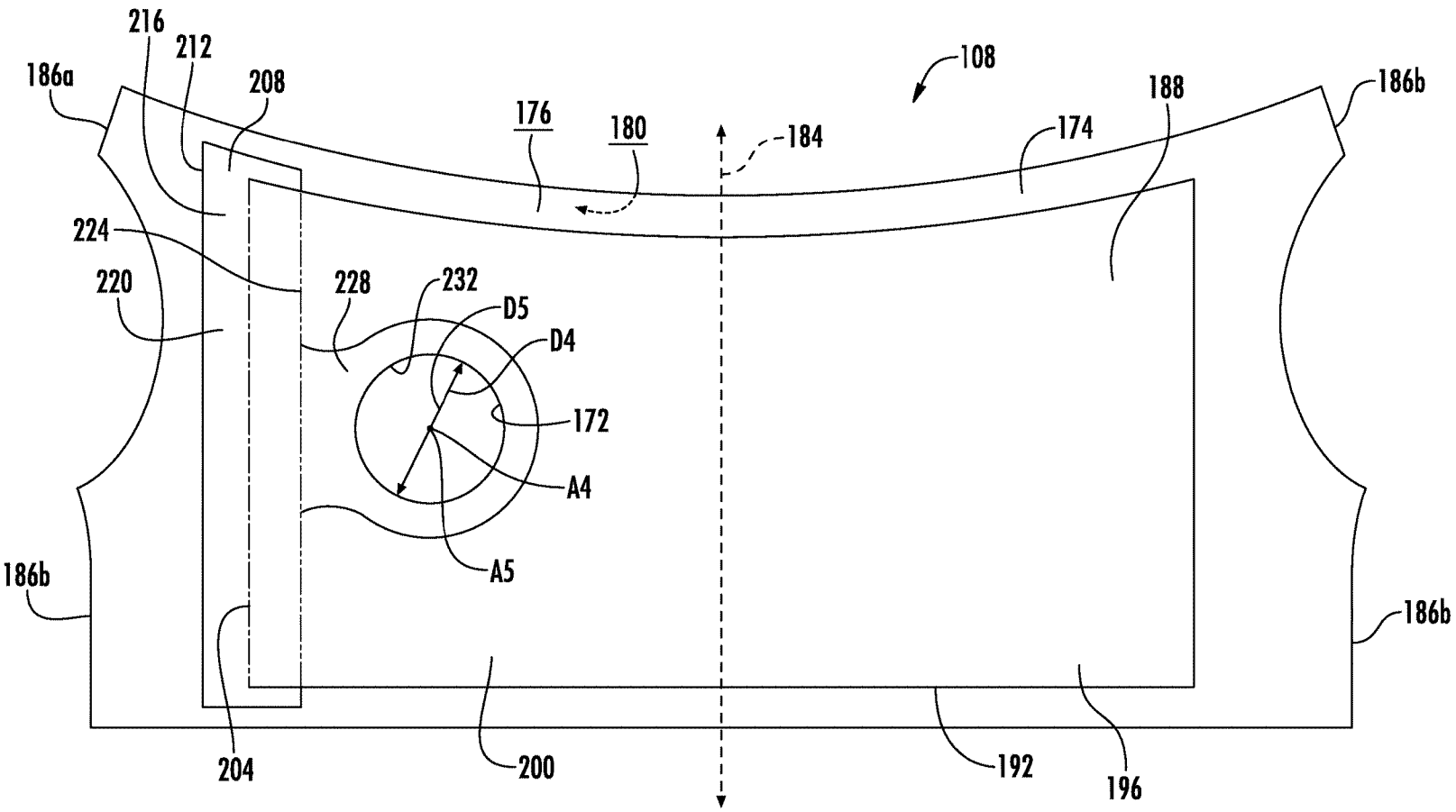
FIG. 6B depicts a schematic plan view of the article of apparel of the pocket portion of the liquid carrying apparatus of FIG. 1 in a flat configuration.

The sleeve 160 includes a main body 174, as well as a panel 188 and a flap 208. The panel 188 is coupled to the main body 174 to form the pocket 200 (shown in FIGS. 1 and 2) between the main body 174 and the panel 188. The panel 188 further includes the cap opening 172, which is in communication with the interior of the pocket 200. The flap 208, having a tab 228 including the tab opening 232, is also coupled to the main body 174 to form a secondary pocket 220 (shown in FIGS. 1 and 2) between the main body 174 and the flap 208. As shown in FIGS. 6A and 6B, prior to being formed into the sleeve 160, the main body 174, the panel 188, and the flap 208 are separate flat pieces.

The main body 174 of the sleeve 160 is made of a flexible, elastic material which is able to stretch to deform and to resume its original shape. For example, the main body 174 can be made of a fabric including elastane threads or neoprene and can be a compression fabric or another tightly fitting fabric. As shown in FIG. 6B, the main body 174 has a first side 176, which is visible in FIG. 6B, and a second side 180, which is opposite of the first side 176 and is indicated with a dashed arrow in FIG. 6B. The panel 188 and the flap 208 are both coupled to the first side 176 of the main body 174 such that the main body 174, the panel 188, and the flap 208 retain the liquid container 104 in the manner described below.

The panel 188 is preferably made of a material which is flexible and elastic. The material of which the panel 188 is made can be the same or a different material as that of which the main body 174 is made. The panel 188 is affixed to the main body 174 by, for example, sewing or stitching. However, if the panel 188 and the main body 174 are made of materials which can be melted to one another, the panel 188 can alternatively be affixed to the main body 174 by heat bonding.

Pocket Formed by Panel

The panel 188 has a perimeter 192 surrounding an interior area 196. The panel 188 is affixed to the main body 174 along a portion of the perimeter 192 of the panel 188 so as to form the pocket 200 (also shown in FIG. 2) between the interior area 196 of the panel 188 and the main body 174 within the perimeter 192. The panel 188 is affixed to the main body 174 along less than the entire perimeter 192 of the panel 188, however, such that a pocket opening 204 (also shown in FIG. 2), which provides access to an interior of the pocket 200, is formed between the panel 188 and the main body 174 along a portion of the perimeter 192 of the panel 188. In FIG. 6B, the portion of the perimeter 192 which is not affixed to the main body 174, and thus forms the pocket opening 204, is indicated by a dash-dot line. It will be recognized that the pocket opening 204 includes two opposing sides defined along two opposing edges of the pocket opening 204. The cap opening 172 is positioned adjacent to a first side of the pocket opening 204. The flap 208 is positioned adjacent to a second side of the pocket opening 204. In the embodiment disclosed herein the pocket opening 204 is generally defined by a polygon, such as a rectangle or a trapezoid, it will be recognized that in other embodiments, the pocket opening 204 may be defined by an ellipse, lens, circle, or any of various other shapes with opposing sides.

The pocket 200 is configured to removably receive the body 112 of the liquid container 104 (shown in FIGS. 3A and 3B). Accordingly, the pocket 200 defines an interior volume between the panel 188 and the main body 174 within the perimeter 192 that is larger than the interior volume 132 of the liquid container 104. Thus, the interior volume 132 of the liquid container 104 determines, at least in part, the interior volume of the pocket 200, and thus determines, at least in part, the dimensions of the perimeter 192 of the panel 188 to enable the interior volume of the pocket 200 to accommodate the liquid container 104.

As shown in FIGS. 6A and 6B, the cap opening 172 is formed in the panel 188 and is substantially circular having a diameter D4 and a central axis A4. The diameter D4 of the cap opening 172 is larger than the exterior diameter D1 of the boss 144 (shown in FIGS. 3A and 3B) to enable the boss 144 to pass through the cap opening 172, as shown in FIG. 2. Accordingly, the sleeve 160 includes two openings to the interior of the pocket 200. The first opening in communication with the interior of the pocket 200 is the pocket opening 204, which is formed by a portion of the perimeter 192 of the panel 188 that is not attached to the main body 174. In other words, the pocket opening 204 provides access to the interior of the pocket 200 between the panel 188 and the main body 174 of the article of apparel 108. The second opening in communication with the interior of the pocket 200 is the cap opening 172, which provides access to the interior of the pocket 200 through the panel 188.

Flap

The flap 208, which includes the tab 228 and the tab opening 232, is also affixed to the first side 176 of the main body 174. Like the main body 174 and the panel 188, the flap 208 is preferably made of a material which is flexible and elastic. The material of which the flap 208 is made can be the same or a different material as that of which the main body 174 of the article of apparel 108 is made and the same or a different material as that of which the panel 188 is made. The flap 208 can be affixed to the main body 174 by, for example, sewing or stitching. However, if the flap 208 and the main body 174 of the article of apparel 108 are made of materials which can be melted to one another, the flap 208 can alternatively be affixed to the main body 174 by heat bonding.

Figure 7:
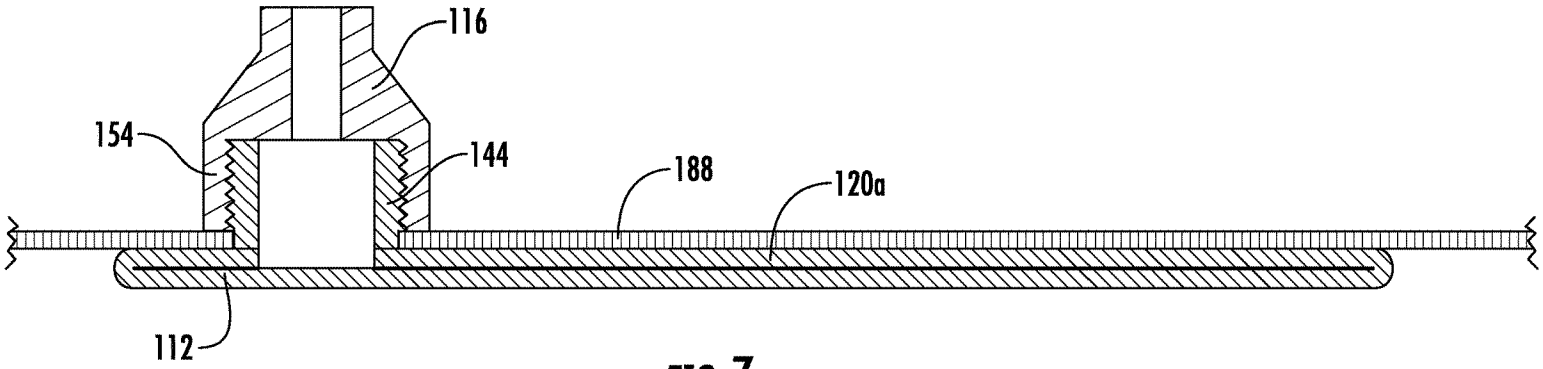
FIG. 7 depicts a side cross-sectional view of the liquid container and a portion of the article of apparatus of the liquid carrying apparatus of FIG. 1 in a flat configuration.

Like the panel 188, the flap 208 has a perimeter 212 surrounding an interior area 216. The flap 208 is affixed to the main body 174 along a portion of the perimeter 212 of the flap 208 so as to form a secondary pocket 220 (also shown in FIG. 2) between the interior area 216 of the flap 208 and the main body 174 within the perimeter 212. The flap 208 is affixed to the main body 174 along less than the entire perimeter 212 of the flap 208, however, such that a secondary pocket opening 224 (also shown in FIG. 2), which provides access to an interior of the secondary pocket 220, is formed between the flap 208 and the main body 174 along a portion of the perimeter 212 of the flap 208. In FIG. 7, the portion of the perimeter 212 which is not affixed to the main body 174 is indicated by a dash-dot-dot line.

The flap 208 further includes the tab 228, which extends from the portion of the perimeter 212 of the flap 208 which is not affixed to the main body 174. The tab 228 also is not affixed to the main body 174, but is coupled to the main body 174 via the portion of the perimeter 212 of the flap 208 which is affixed to the main body 174. The tab opening 232, formed in the tab 228, is substantially circularly shaped having a diameter D5 and a central axis A5. The diameter D5 of the tab opening 232 is substantially the same size as the diameter D4 of the cap opening 172, and is thus configured to pass the boss 144 of the liquid container 104 therethrough. In other words, the tab 228, including the tab opening 232, essentially forms a loop which extends from the flap 208.

When the panel 188 and the flap 208 are arranged to form the sleeve 160 with the main body 174, the panel 188 and the flap 208 are arranged relative to one another such that the portion of the perimeter 212 of the flap 208 which is not coupled to the main body 174 overlaps the portion of the perimeter 192 of the panel 188 which is not coupled to the main body 174. Thus, the pocket opening 204 of the pocket 200 is arranged between the main body 174 and the interior area 216 of the flap 208 such that the pocket opening 204 of the pocket 200 is arranged within the interior of the secondary pocket 220. Accordingly, the pocket opening 204 provides access to the pocket 200 from within the secondary pocket 220. In other words, the pocket opening 204 is accessible via the secondary pocket opening 224.

Additionally, the panel 188 and the flap 208 are arranged relative to one another such that the central axis A4 of the cap opening 172 of the panel 188 is approximately coaxial with the central axis A5 of the tab opening 232 of the flap 208. Because the diameter D5 of the tab opening 232 is substantially the same size as the diameter D4 of the cap opening 172, the cap opening 172 and the tab opening 232 are also substantially aligned with one another.

Sleeve Assembly

With reference again to FIGS. 6A and 6B, in order to form the sleeve 160, the panel 188 is first affixed to the main body 174 to form the pocket 200 having the pocket opening 204. Next, the flap 208 is affixed to the main body 174 to form the secondary pocket 200 having the secondary pocket opening 224. Because, the flap 208 is not affixed to the main body 174 on the portion of the perimeter 212 which forms the secondary pocket opening 224, the flap 208 is movable between a closed position (shown in FIG. 1) and an opened position (shown in FIG. 2). In the closed position, as described above, the central axis A5 of the tab opening 232 is approximately coaxial with the central axis A4 of the cap opening 172. In the open position, however, the central axis A5 of the tab opening 232 is not approximately coaxial with the central axis A4 of the cap opening 172. Thus, the panel 188 and the flap 208 are arranged relative to one another as described above.

Once the panel 188 and the flap 208 are affixed to the main body 174, the article of apparel 108 is arranged as shown in FIG. 6B. Next, the second side 180 of the main body 174 is folded on top of itself along the dashed line 184 and edges 186*a* are coupled to corresponding edges 186*b* by, for example, sewing or heat bonding. Thus, the second side 180 of the main body 174 forms an inwardly facing side 166 of the sleeve 160 (shown in FIGS. 1 and 2) and the first side 176 of the main body 174 forms an outwardly facing side 170 of the sleeve 160. When the sleeve 160 is worn by a user, the inwardly facing side 166 is in contact with the user's body and the outwardly facing side 170 faces away from the user's body.

Liquid Container Carried by the Sleeve

In order to insert the liquid container 104 into the sleeve 160 such that it is carried by the sleeve, the user inserts the body 112 into the interior of the pocket 200. Due to the arrangement of the pocket opening 204 within the secondary pocket 220, the liquid container 104 can only be inserted into the pocket 200 via both the secondary pocket opening 224 and the pocket opening 204. Accordingly, the liquid container 104 can only be inserted into the pocket 200 when the flap 208 is in the opened position such that the pocket opening 204 providing access to the pocket 200 is not covered by the flap 208 and the tab 228.

Because the panel 188 and the flap 208 are both made of a material which is flexible and elastic, when the flap 208 is in the opened position, the user simply separates the flap 208 from the main body 174 at the secondary pocket opening 224 and separates the panel 188 from the main body 174 at the pocket opening 204 to provide access to the interior of the pocket 200.

Once the liquid container 104 is inserted into the pocket 200, the user manipulates the sleeve 160 and/or the liquid container 104 to position the boss 144 within the cap opening 172. With reference to FIG. 6B, the panel 188 is affixed to the main body 174 at a position such that when the liquid container 104 is received within the pocket 200, the liquid opening 140 and the boss 144 (shown in FIGS. 3A and 3B) are aligned with the cap opening 172. In the embodiment shown, the pocket opening 204 is arranged near the cap opening 172 to facilitate insertion of the liquid container 104 into the pocket 200. In other words, because the pocket opening 204 is arranged near the cap opening 172, when the liquid container 104 is inserted into the pocket 200, the boss 144 does not have to be manipulated to travel far within the pocket 200 to arrive at the cap opening 172. For easiest insertion of the liquid container 104 into the pocket 180, the panel 188 is coupled to the sleeve 160 such that the pocket opening 204 is arranged as near as possible to the cap opening 172 while retaining enough of the panel 188 around the cap opening 172 to maintain structural integrity of the panel 188, the cap opening 172, and the pocket opening 204.

When the boss 144 is received within the cap opening 172, the central axis A4 of the cap opening 172 is aligned so as to be approximately coaxial with the central longitudinal axis A1 of the boss 144. When the central axis A4 of the cap opening 172 is approximately coaxial with the central longitudinal axis A1 of the boss 144, the liquid container 104 is in a preferred use position within the article of apparel 108.

The diameter D4 of the cap opening 172 is near enough in size to the exterior diameter D1 of the boss 144 such that when the boss 144 is generally retained within the cap opening 172 and the liquid container 104 is in the preferred use position, little movement of the boss 144 is possible in a direction perpendicular to the direction of insertion. In other words, the relative size of the diameter D4 of the cap opening 172 and the exterior diameter D1 of the boss 144 retain the boss 144 such that the central axis A4 of the cap opening 172 is maintained approximately coaxially with the central longitudinal axis A1 of the boss 144 and the liquid container 104 is in the preferred use position.

In at least one embodiment, the diameter D4 of the cap opening 172 is smaller than the exterior diameter D3 of the mating portion 154 of the cap 116 (shown in FIGS. 3A and 3B). Accordingly, in such embodiments, the cap 116 cannot be coupled to the boss 144 before the boss 144 is passed through the cap opening 172. Instead, the cap 116 can only be coupled to the boss 144 after the body 112 has been inserted into the pocket 200 and the boss 144 has been passed through the cap opening 172. Then, as shown in FIG. 7, when the cap 116 is subsequently coupled to the boss 144, a portion of the panel 188 around the cap opening 172 is trapped between the mating portion 154 of the cap 116 and the top panel 120*a* of the liquid container 104. Trapping a portion of the panel 188 between the cap 116 and body 112 of the liquid container 104 further helps to retain the boss 144 within the cap opening 172 such that the central axis A4 of the cap opening 172 is maintained approximately coaxially with the central longitudinal axis A1 of the boss 144 and the liquid container 104 is in the preferred use position.

In another embodiment, because the panel 188 is preferably formed from a flexible, elastic material, the cap opening 172 is able to be stretched to enable the diameter D4 of the cap opening 172 to pass the larger exterior diameter D3 of the mating portion 154 of the cap 116. In this embodiment, the cap 116 can be coupled to or separated from the body 112 of the liquid container 104 when the liquid container 104 is inserted into the article of apparel 108 and the boss 144 is inserted into the cap opening 172. In other words, in this embodiment, the cap 116 can be coupled to the body 112 before the liquid container 104 is inserted into the article of apparel 108, because the cap opening 172 can be stretched to accommodate the cap 116. Once the liquid container 104 is in the preferred use position, the elasticity of the panel 188 enables the diameter D4 of the cap opening 172 to return to near its original shape and size to help retain the liquid container 104 at the preferred use position.

Once the liquid container 104 is in the preferred use position within the pocket 200, the liquid carrying apparatus 100 is arranged as shown in FIG. 2. Next, the flap 208 is moved to the closed position, as shown in FIG. 1. Because the diameter D5 of the tab opening 232 is substantially the same size as the diameter D4 of the cap opening 172, the relative size of the diameter D5 of the tab opening 232 and the exterior diameter D1 of the boss 144 further retain the boss 144 such that the central axis A5 of the tab opening 232 is maintained approximately coaxially with the central longitudinal axis A1 of the boss 144.

In one embodiment, like the diameter D4 of the cap opening 172, the diameter D5 of the tab opening 232 is also smaller than the exterior diameter D3 of the mating portion 154 of the cap 116 such that the cap 116 can only be coupled to the boss 144 after the body 112 has been inserted into the pocket 200 and the boss 144 has been passed through both the cap opening 172 and the tab opening 232. In this embodiment, like the panel 188, a portion of the tab 228 is also trapped between the mating portion 154 of the cap 116 and the top panel 120*a* of the liquid container 104.

In another embodiment, because the flap 208 is also preferably formed from a flexible, elastic material, the tab opening 232 is able to be stretched to enable the diameter D5 of the tab opening 232 to pass the exterior diameter D3 of the mating portion 154 of the cap 116 such that the cap 116 can be coupled to the body 112 before the liquid container 104 is inserted into the article of apparel 108.

As shown in FIG. 1, once the liquid container 104 is at the preferred use position, and the longitudinal axis A1 of the boss 144 is substantially coaxial with the central axis A4 of the cap opening 172 and the central axis A5 of the tab opening 232, the liquid carrying apparatus 100 is ready for use. In use, the secondary pocket opening 224 faces the opposite direction as the pocket opening 204. For example, as shown in FIG. 6B, the secondary pocket opening 224 faces rightwardly while the pocket opening 204 faces leftwardly. This arrangement of the flap 208 relative to the panel 188 helps to retain the liquid container 104 within the pocket 200 of the article of apparel 108 because the pocket opening 204 through which the liquid container 104 is inserted into the pocket 200 is covered by the flap 208, and the secondary pocket 220 further retains a portion of the liquid container 104 which is arranged nearest to the pocket opening 204.

Additionally, as shown in FIGS. 1 and 2, in use the tab 228 and the tab opening 232 further help retain the liquid container 104 at the preferred use position within the pocket 200 when the boss 144 and/or the cap 116 is inserted through the cap opening 172 and the tab opening 232. Because the tab 228 extends from the flap 208 on the same side of the flap 208 that forms the secondary pocket opening 224, the tab 228 is anchored to the main body 174 of the article of apparel 108 at the opposite side of the flap 208. Thus, tab 228, which includes the tab opening 232, provides stability to the boss 144 and/or the cap 116 of the liquid container 104 by applying a force from a first direction away from the secondary pocket opening 224.

In FIGS. 1 and 2, the tab 228 provides stability from the leftward side of the article of apparel 108. Conversely, the cap opening 172 is arranged on the panel 188 near to the same side of the panel 188 which forms the pocket opening 204. Accordingly, the portion of the panel 188 which includes the cap opening 172 is anchored to the article of apparel 108 at the opposite side of the panel 188. Thus, the portion of the panel 188 which includes the cap opening 172 provides stability to the boss 144 and/or the cap 116 of the liquid container from a second direction, opposite the first direction, away from the pocket opening 204. In FIGS. 1 and 2, the panel 188 provides stability from the rightward side of the article of apparel 108.

In other words, because the secondary pocket opening 244 faces in the opposite direction as the pocket opening 204, the tab 228 and the portion of the panel 188 which includes the cap opening 172 provide stability to the liquid container 104 by applying forces to the cap from opposite directions when the boss 144 and/or the cap 116 is received within the tab opening 232 and the cap opening 172. This arrangement helps further retain the liquid container 104 at the preferred use position within the pocket 200.

In the embodiment shown in FIG. 6B, the panel 188 and the flap 208 are attached to the first side 176 of the main body 174 of the article of apparel 108, and the cap opening 172 is formed in the panel 188. Accordingly, when the main body 174 is folded and closed to form the sleeve 160, the panel 188, the flap 208, and the cap opening 172 are arranged on the outwardly facing side 170 of the sleeve 160 (shown in FIGS. 1 and 2). This arrangement facilitates access to the interior of the pocket 200 via the pocket opening 204 in conjunction with the secondary pocket opening 224. In an alternative embodiment, however, the panel 188 and the flap 208 can be attached to the second side 180 of the main body 174 and the cap opening 172 can be formed in the main body 174 such that, when the main body 174 is folded to form the sleeve 160, the panel 188 and the flap 208 are arranged on the inwardly facing side 166 of the sleeve 160, but the cap opening 172 is still arranged on the outwardly facing side 170 of the sleeve 160. In another alternative embodiment, the panel 188 can be attached to the second side 180 of the main body 174 and the sleeve 160 can be formed without a flap 208. In this embodiment, because the panel 188 will be arranged on the inwardly facing side 166 of the sleeve 160, the liquid container 104 is less likely to slide out of the pocket 200, so there is less need for the flap 208 to help retain the liquid container 104 within the pocket 200.

Additional Retaining Features

Figure 8:
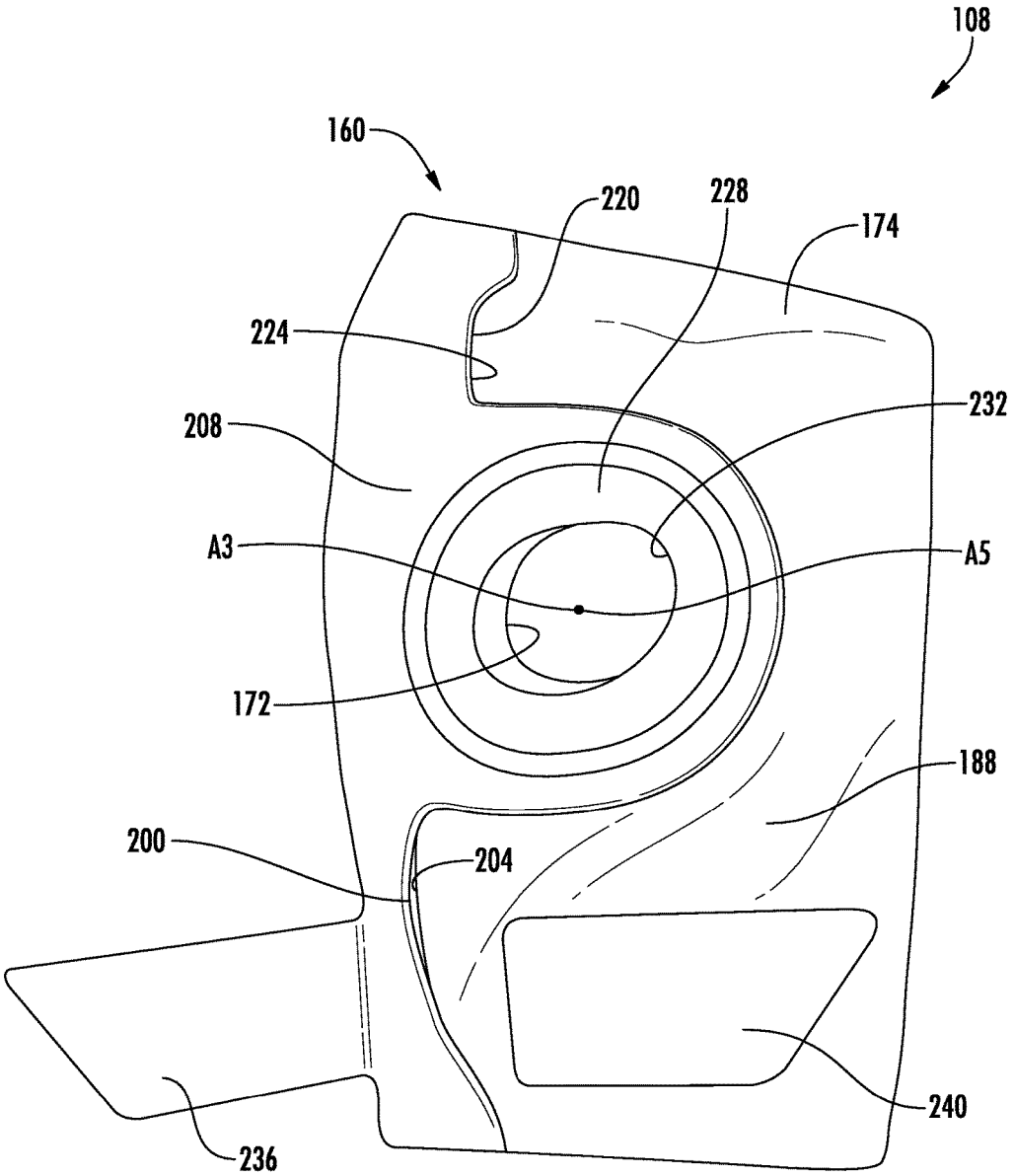
FIG. 8 depicts a front perspective view of the article of apparel of the liquid carrying apparatus of FIG. 1 with the flap in the closed position.
Figure 9:
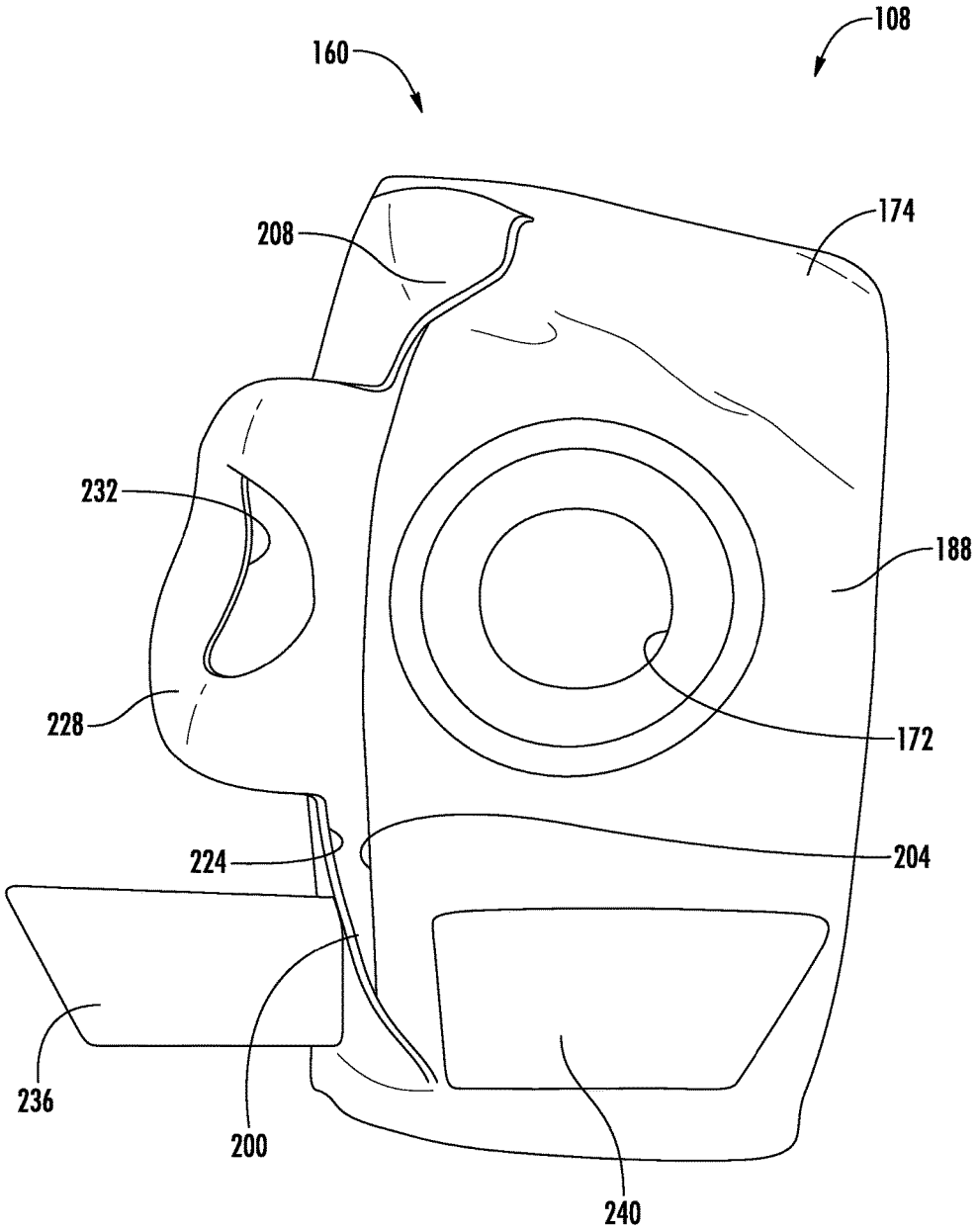
FIG. 9 depicts a front perspective view of the article of apparel of the liquid carrying apparatus of FIG. 1 with the flap in the opened position.

As shown in FIGS. 8 and 9, the article of apparel 108 may further includes a first closing portion 236 and a second closing portion 240 configured to be removably coupled together to further help retain the liquid container 104 within the pocket 200 by restricting access to the pocket opening 204. In the embodiment shown, the first closing portion 236 is coupled to the main body 174 to the left of the flap 208 and the second closing portion 240 is coupled to the main body 174 to the right of the flap 208. When the first closing portion 236 and the second closing portion 240 are removably coupled together (as shown in FIG. 1), the main body 174 is held together on opposite sides of the flap 208, which helps retain the flap 208 in the closed position and helps to prevent access to the pocket 200 via the secondary pocket opening 224 and the pocket opening 204. In other words, when the first closing portion 236 and the second closing portion 240 are coupled together, the liquid container 104 is more securely retained within the pocket 200. When the first closing portion 236 and the second closing portion 240 are not removably coupled together (as shown in FIG. 2), the main body 174 is not held together on opposite sides of the flap 208 and the flap 208 is able to be moved to the opened position more easily.

In the embodiment shown, the first closing portion 236 is formed as a strip of material including a closing feature and the second closing portion 240 is formed on the panel 188 and includes a mating closing feature. The closing feature and mating closing feature can be, for example, a hook and loop closing feature or a snap closing feature. To couple the first closing portion 236 to the second closing portion 240, the strip of material of the first closing portion 236 is moved over the flap 208 and onto the second closing portion 240 (as shown in FIG. 1). In use, the first closing portion 236 is wrapped around the user's wrist and coupled to the second closing portion 240 which is arranged on the dorsal side of the user's hand. In alternative embodiments, the article of apparel 108 can include different closing portions and/or features which are removably engageable to help retain the flap 208 in the closed position and help to prevent access to the pocket 200 via the secondary pocket opening 224 and the pocket opening 204.

The foregoing detailed description of one or more embodiments of the liquid carrying apparatus has been presented herein by way of example only and not limitation. It will be recognized that there are advantages to certain individual features and functions described herein. Moreover, it will be recognized that various alternatives, modifications, variations, or improvements of the above-disclosed embodiments and other features and functions, or alternatives thereof, may be desirably combined into many other different embodiments, systems, or applications. Presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. An apparatus for carrying liquid, comprising:

a liquid container including a body configured to removably receive the liquid and a cap configured to selectively seal the body; and an article of apparel, including:

a pocket having an interior configured to removably receive the body;

a first opening in communication with the interior of the pocket, the first opening configured to pass the liquid container;

a second opening in communication with the interior of the pocket, the second opening spaced apart from the first opening and configured to pass the cap; and a flap movably coupled to the article of apparel, the flap including a third opening configured to pass the cap.

2. The apparatus of claim 1, wherein the first opening includes a first side and an opposing second side, the second opening positioned adjacent to the first side of the first opening and the flap positioned adjacent to the second side of the first opening.

3. The apparatus of claim 1, wherein the body defines an interior volume of between 150 mL and 300 mL.

4. The apparatus of claim 1, wherein: the body comprises two panels, which define an interior volume of the body therebetween, each of the panels having at least three perimeter edges, the body includes a liquid opening through which the liquid is inserted into and removed from the interior volume, and the liquid opening is arranged nearer to one of the at least three perimeter edges than to another of the at least three perimeter edges.

5. The apparatus of claim 4, wherein: the body further comprises a boss surrounding the liquid opening, the boss being shaped substantially as a hollow cylinder having a first diameter, and the cap is configured to matingly engage with the boss to selectively seal the liquid opening.

6. The apparatus of claim 5, wherein: the article of apparel is made of a stretchable material; and the second opening has a second diameter and the third opening has a third diameter such that the boss is received in the second opening and the third opening.

7. The apparatus of claim 1, wherein: the article of apparel comprises a main body and a panel coupled to the main body such that the pocket is formed between the main body and the panel, and the second opening is formed in the panel.

8. The apparatus of claim 7, wherein: the main body includes a first side, configured to be in contact with a user when the article of apparel is worn, and a second side, configured to face away from the user when the article of apparel is worn, and the panel is coupled to the second side of the main body.

9. The apparatus of claim 7, wherein: the first opening is formed at an interface between the main body and the panel, and the flap is coupled to the main body and configured to selectively cover the first opening.

10. An apparatus for carrying liquid, comprising:

a liquid container including a body configured to removably receive the liquid and a cap configured to selectively seal the body; and an article of apparel, including:

a pocket having an interior configured to removably receive the body;

a first opening in communication with the interior of the pocket, the first opening configured to pass the liquid container;

a second opening in communication with the interior of the pocket, the second opening spaced apart from the first opening and configured to pass the cap; and a flap coupled to the article of apparel and movable between a first position and a second position, whereat the flap engages the cap in the first position, and the cap does not engage the cap in the second position.

11. The apparatus of claim 10 wherein the flap is trapped between the cap and the liquid container when the flap is in the first position.

12. The apparatus of claim 10, wherein: the article of apparel comprises a main body and a panel coupled to the main body such that the pocket is formed between the main body and the panel, and the second opening is formed in the panel.

13. The apparatus of claim 12, wherein: the first opening is formed at an interface between the main body and the panel, and the flap is coupled to the main body.

14. The apparatus of claim 10, wherein the flap includes a third opening configured to pass the cap.

15. The apparatus of claim 14, wherein: the third opening is aligned with the second opening when the flap is in the first position, and the third opening is not aligned with the second opening when the flap is in the second position.

16. The apparatus of claim 15, wherein: the body of the liquid container comprises two panels which define an interior volume of the body therebetween, and the body includes a liquid opening through which the liquid is inserted into and removed from the interior volume.

17. The apparatus of claim 16, wherein: each of the panels has at least three perimeter edges, and the liquid opening is arranged nearer to one of the at least three perimeter edges than to other perimeter edges.

18. The apparatus of claim 17, wherein: the body further comprises a boss surrounding the liquid opening, the boss being shaped substantially as a hollow cylinder having a first diameter, the second opening and the third opening are configured to receive the boss; and the cap is configured to matingly engage with the boss to selectively seal the liquid opening.

19. The apparatus of claim 10, wherein the article of apparel is a glove comprised of a stretchable material.

20. An apparatus for carrying a liquid, the apparatus comprising:

an article of apparel including a pocket and a pocket opening, the pocket opening defined by a first side and a second side opposite the first side, a first hole positioned adjacent to the first side of the pocket opening, a flap positioned adjacent to the second side of the pocket opening, and a second hole positioned on the flap; and a liquid container retained in the pocket, the liquid container including a liquid opening with a boss surrounding the liquid opening, the boss extending through the first hole and the second hole.

* * * * *